US007650949B1

(12) United States Patent
Horstman

(10) Patent No.: US 7,650,949 B1
(45) Date of Patent: Jan. 26, 2010

(54) REMOVABLE WEAR STRIP FOR MOLDBOARD SIDESHIFT RAIL

(75) Inventor: Nathan J. Horstman, Durango, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 12/236,265

(22) Filed: Sep. 23, 2008

(51) Int. Cl.
*E02F 3/00* (2006.01)

(52) U.S. Cl. ..... 172/795; 172/781; 37/281

(58) Field of Classification Search ..... 172/772, 172/778, 780, 781, 791, 793, 795; 37/274, 37/281; 384/42
See application file for complete search history.

(56) References Cited

U.S. PATENT DOCUMENTS

| | | | | | |
|---|---|---|---|---|---|
| 1,918,881 | A * | 7/1933 | Wilson | 172/793 |
| 3,425,497 | A * | 2/1969 | Strabala et al. | 172/792 |
| 3,463,243 | A * | 8/1969 | Fisher | 172/781 |
| 3,465,829 | A * | 9/1969 | McCarthy et al. | 172/667 |
| 3,512,589 | A * | 5/1970 | Ulrich | 172/786 |
| 3,593,806 | A * | 7/1971 | Gurries | 172/741 |
| 4,074,767 | A * | 2/1978 | Cole | 172/781 |
| 4,084,643 | A * | 4/1978 | Easterling | 172/795 |
| 4,105,078 | A * | 8/1978 | Gilbert | 172/781 |
| 4,683,959 | A * | 8/1987 | Clemens | 172/795 |
| 4,921,359 | A * | 5/1990 | Sakamoto | 384/18 |
| 5,076,370 | A * | 12/1991 | Stubben et al. | 172/781 |
| 5,261,170 | A * | 11/1993 | Ward | 37/451 |
| 5,687,800 | A * | 11/1997 | Wilkening | 172/811 |
| 6,585,059 | B2 * | 7/2003 | Michael et al. | 172/811 |
| 6,799,640 | B2 * | 10/2004 | McGugan | 172/795 |
| 6,904,978 | B2 * | 6/2005 | McGugan | 172/795 |
| 2008/0138154 | A1 | 6/2008 | Horstman et al. | |

OTHER PUBLICATIONS

Pictures of Moldboard Support Systems (9 pages) (Mar. 2008). Statement of Prior Art.

* cited by examiner

*Primary Examiner*—Robert E Pezzuto
*Assistant Examiner*—Jamie L McGowan

(57) ABSTRACT

A moldboard of a work vehicle comprises a blade and a sideshift rail comprising a bar attached to the blade and a wear strip removably mounted to the bar.

19 Claims, 7 Drawing Sheets

REMOVABLE WEAR STRIP FOR MOLDBOARD SIDESHIFT RAIL

FIELD OF THE DISCLOSURE

The present disclosure relates to work vehicles with a moldboard. More particularly, the present disclosure relates to a sideshift rail of the moldboard.

BACKGROUND OF THE DISCLOSURE

Motor graders have a moldboard for moving earthen or other material. There are known motor graders that have a main frame, or chassis, to which a draft frame is attached via a ball-and-socket joint, a saddle frame attached to the main frame, a number of hydraulic cylinders (e.g., three) interconnecting the saddle frame and the draft frame for raising and lowering the sides of the draft frame and moving the draft frame side-to-side about the ball-and-socket joint, a circle frame rotatably attached to the draft frame, and a moldboard support having a tilt frame that is attached to the circle frame for rotation therewith and to which the moldboard is mounted. The tilt frame is pivoted to the circle frame to change the pitch of the moldboard in response to actuation of a hydraulic cylinder. A hydraulic sideshift cylinder interconnects the tilt frame and the moldboard and is operable to sideshift the moldboard relative to the moldboard support (i.e., to move the moldboard in translation relative to the moldboard support along a longitudinal axis of the moldboard).

There are known moldboards that have an upper sideshift rail and a lower sideshift rail. Each sideshift rail is in the form of a bar that is fixed to the back of a blade of the moldboard via a longitudinal channel to which the bar is welded and that is received by replaceable wear components, in the form of wear inserts, of two upper and two lower jaws of the moldboard support, mounted to the tilt frame, for sideshifting of the moldboard relative to the moldboard support in response to actuation by a moldboard-sideshift actuator in the form of a hydraulic cylinder.

Operationally, motor graders are versatile machines that are used to perform all sorts of tasks. Motor graders are often used for "rough grading" where the grader is used to move or level large quantities of material quickly. During the process of rough grading, the material will often spill over the top of the blade of the moldboard onto the bars and reside there. This material may include very abrasive particles, which can be ingested in between the wear components and the bars, resulting in rapid wear of the wear components and the bars when the moldboard is sideshifted. With such wear, the grip on the bars by the wear components loosens. This looseness resulting from wear in a rough grading operation as described here is not a hindrance to the performance of that particular operation, but it is unacceptable if the grader is then moved to a fine-grading task.

To eliminate looseness between the wear components and the bars, the upper jaws may be reconditioned by removing one or more shims in order to tighten the grip of the wear components on the bars or by replacing the wear components. Over time, wear on the bars themselves becomes excessive, and the ability to tighten the grip of the wear components by adjusting or replacing the wear components is no longer effective. Solutions to this issue have included removing and replacing the entire moldboard (after which the worn moldboard is sometimes scrapped altogether or relegated to some other old grader that does no finish work), or removing and replacing just the worn bar, both of which have drawbacks (e.g., cost, inconvenience, and operational downtime).

SUMMARY OF THE DISCLOSURE

According to the present disclosure, there is provided a work vehicle comprising a moldboard support and a moldboard mounted to and held by the moldboard support. The moldboard comprises a blade and a sideshift rail. The sideshift rail comprises a bar attached to the blade and a wear strip removably mounted to, and extending along, the bar so as to cover at least a portion of the bar and contacting the moldboard support for slidable movement against the moldboard support upon sideshifting of the moldboard relative to the moldboard support (such "sideshifting of the moldboard relative to the moldboard support" meaning "translation of the moldboard relative to the moldboard support along a longitudinal axis of the moldboard"). The wear strip, or a portion thereof, can be removed and replaced when it is worn, without requiring removal of the bar from the blade, removal of the moldboard from the work vehicle, or replacement of the entire moldboard.

Exemplarily, the wear strip may be segmented along its length. In such a case, the wear strip may comprise a plurality of individual strip segments removably mounted to the bar in-line with one another. In this way, a worn strip segment, such as one in a relatively high wear area (e.g., the middle region of the sideshift rail) can be removed and replaced with a new strip segment or one of the other, less worn strip segments.

Further exemplarily, there may be more than one wear strip removably mounted to the bar (e.g., two). In such a case, each wear strip may be removably mounted on a respective surface of the bar.

In an embodiment, the moldboard has two such sideshift rails, an upper sideshift rail and a lower sideshift rail, both having a bar attached to the back of the blade and first and second wear strips removably mounted to the bar. The wear strips of the upper sideshift rail are arranged for slidable movement against wear components of a pair of upper jaws of the moldboard support, and the wear strips of the lower sideshift rail are arranged for slidable movement against wear components of a pair of lower jaws of the moldboard support. Further, each wear strip may be segmented along its length into a plurality of individual strip segments, as noted above, for ready replacement of a worn, or partially worn, strip segment by one of the other less worn strip segments or a new strip segment. Such maintenance of the sideshift rails could be done, for example, at the job site, without having to remove or replace the entire moldboard or a bar thereof.

The above and other features will become apparent from the following description and the attached drawings.

BRIEF DESCRIPTION OF THE DRAWINGS

The detailed description of the drawings refers to the accompanying figures in which.

DETAILED DESCRIPTION OF THE DRAWINGS

Figure 1:
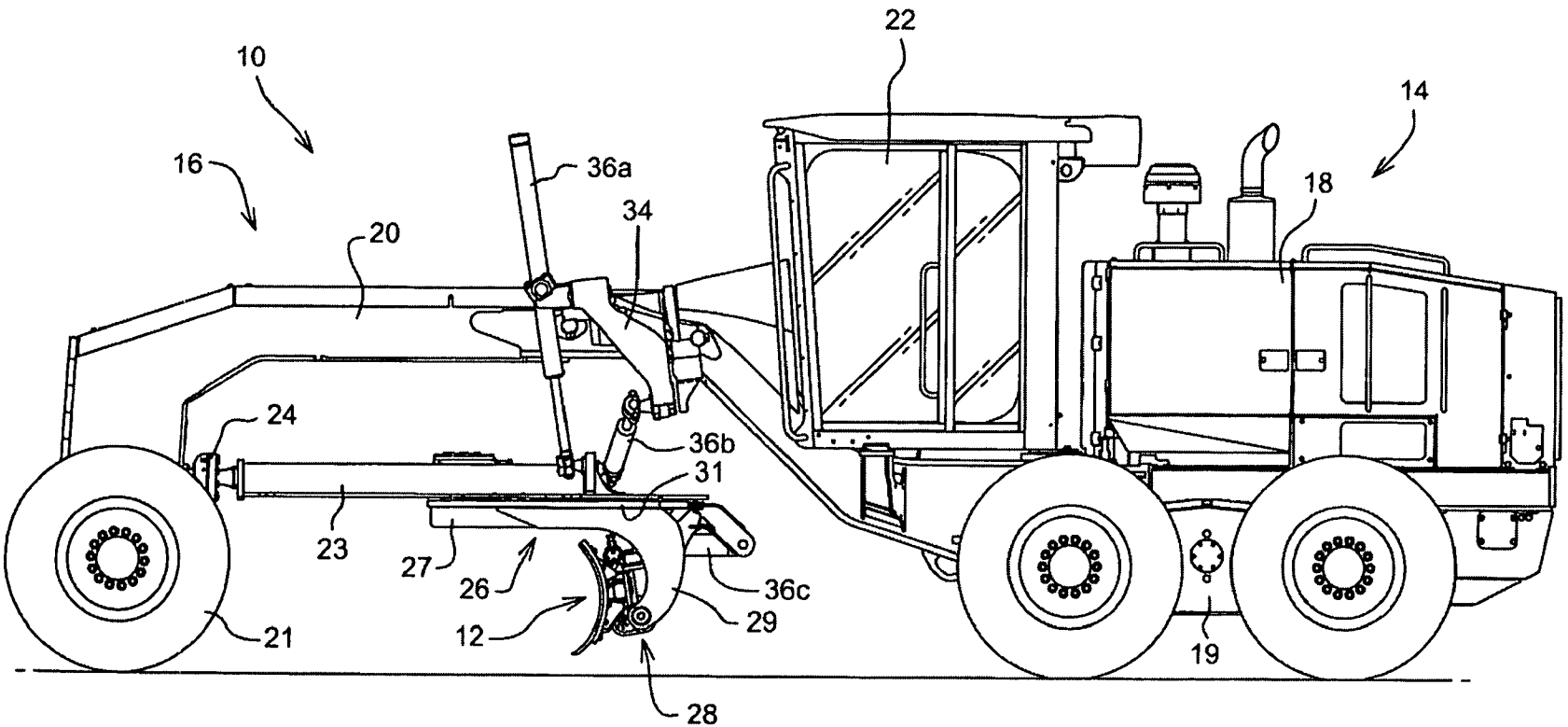
FIG. 1 is a side elevation view of a work vehicle in the form of, for example, a motor grader.

A work vehicle 10 has a moldboard 12 for moving earthen or other material, as shown, for example, in FIG. 1. Exemplarily, the work vehicle 10 is illustrated and described below as a motor grader.

In this motor grader example, the vehicle 10 has a rear section 14 and a front section 16. The rear and front sections 14, 16 are articulated to one another for relative movement about an articulation axis at the articulation joint. The rear section 14 has an engine compartment 18 containing an engine for propulsion of the vehicle 10 and operation of the onboard hydraulic system. The rear section 14 further has a set of tandem wheels 19 on each side of the rear section 14.

The front section 16 has a main frame, or chassis, 20 supporting other structures of the front section 16. A pair of front wheels 21 supports the frame 20 above the ground. The operator's station 22, from which an operator can control operation of the vehicle 10, is mounted on the main frame 20. A draft frame 23 is attached to the main frame 20 via a ball-and-socket joint 24 near the front of the main frame 20. A circle frame 26 is rotatably attached to the draft frame 23 near the rear of the draft frame 23. The circle frame 26 has a circle gear 27 rotatable by a circle drive (e.g., hydraulic motor with pinion gear) mounted to the draft frame 23. Two legs 29, shown, for example, in FIG. 2, depend from a circle gear platform 31 supporting the circle gear 27.

Figure 3:
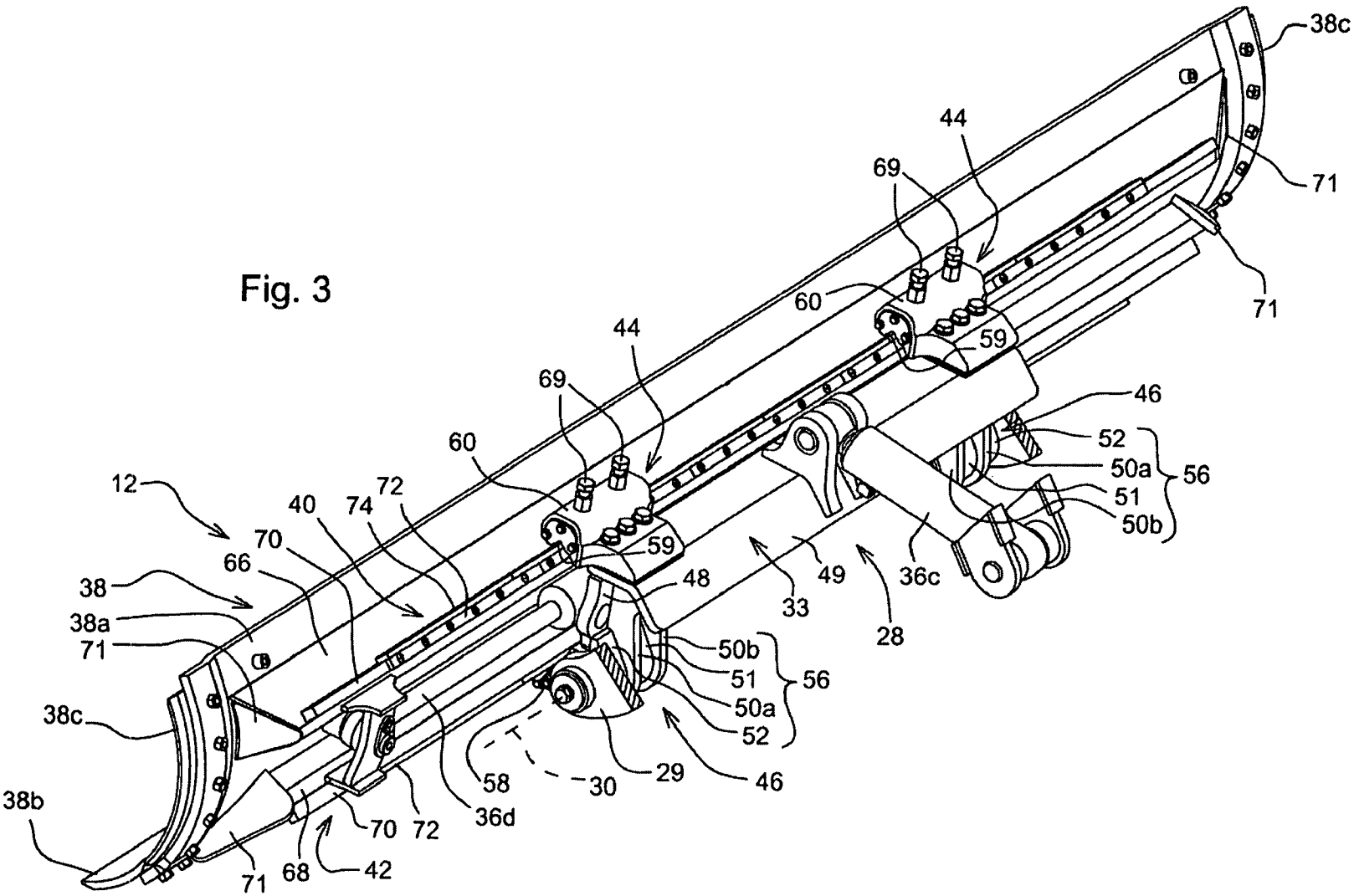
FIG. 3 is a rear perspective view, with much of the circle frame broken away, showing the moldboard mounted to the moldboard support.
Figure 4:
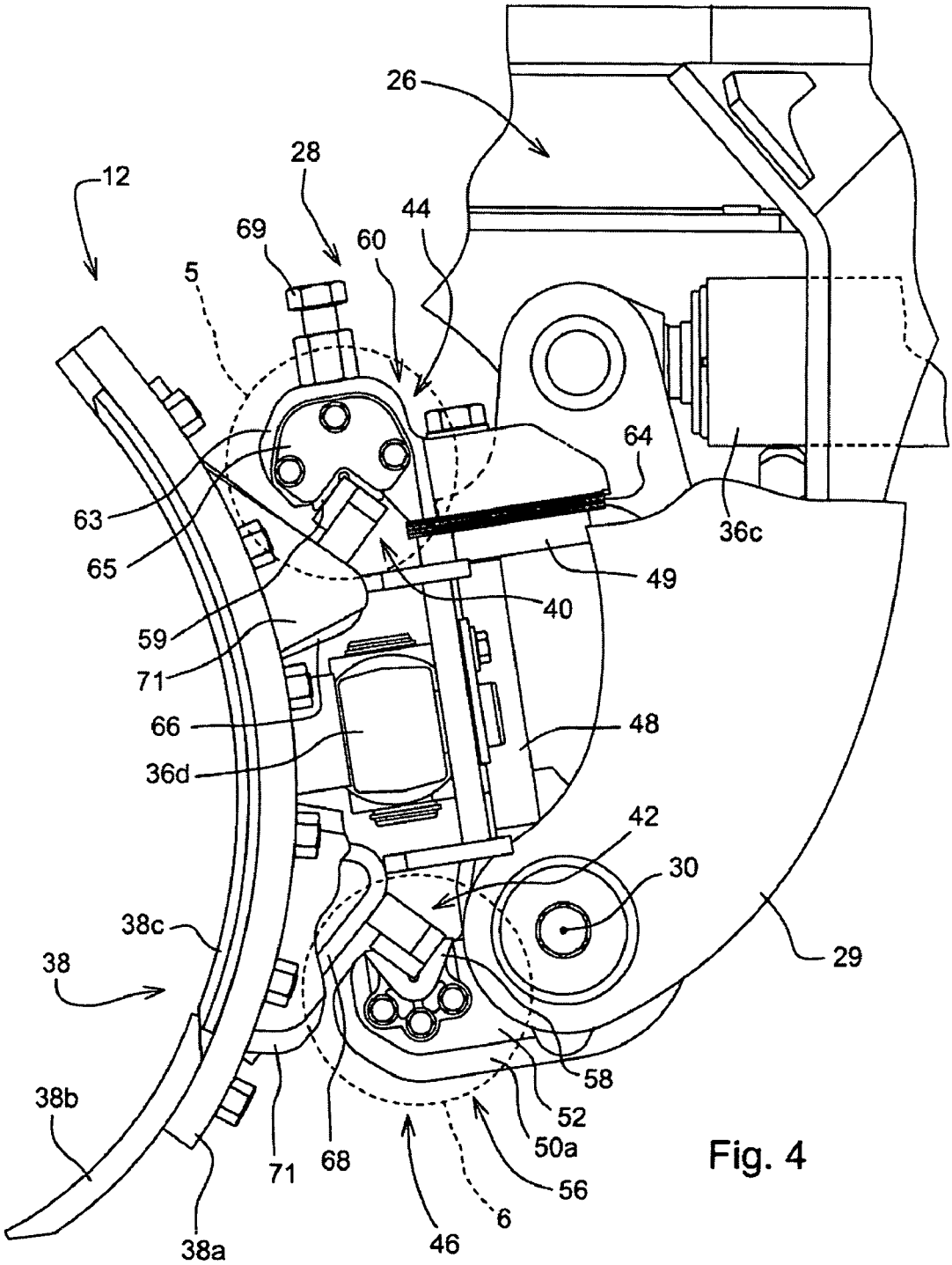
FIG. 4 is a side elevation view showing the moldboard and moldboard support.

The moldboard 12 is mounted to a moldboard support 28, an embodiment of which is shown, for example, in FIGS. 3 and 4. Exemplarily, the moldboard support 28 has a tilt frame 33, two adjustable upper jaws 44, and two lower jaws 46 provided in part by the tilt frame 33. The tilt frame 33 is attached to the legs 29 for pivotal movement of the moldboard support 28 and the moldboard 12 relative to the circle frame 26 about a pivot axis 30. The upper and lower jaws 44, 46 are attached to, or partially included in, the tilt frame 33 and cooperate to provide a moldboard holder that holds the moldboard 12 in a manner that allows sideshifting of the moldboard 12 relative to the moldboard support 28, such "sideshifting of the moldboard 12 relative to the moldboard support 28" meaning "translation of the moldboard 12 relative to the moldboard support 28 along a longitudinal axis 32 of the moldboard 12." U.S. patent application Ser. No. 11/608,670, filed on 8 Dec. 2006 and entitled "wrenchless Adjustable/Compliant Moldboard Insert," is hereby incorporated by reference herein and discloses embodiments useful as the moldboard support 28.

Actuators 36 in the form of, for example, hydraulic cylinders are configured to move the moldboard 12, as shown, for example, in FIG. 1. Left and right lift actuators 36*a* are mounted to a saddle frame 34 which is attached to the main frame 20 (left lift actuator 36*a* shown, for example, in FIG. 1). The lift actuators 36*a* are attached to the left and right sides of the draft frame 23 to raise and lower the left and right sides of the draft frame 23, and thus the left and right sides of the moldboard 12, relative to the main frame 20. A frame-sideshift actuator 36*b* is mounted to the saddle frame 34 and attached to the draft frame 23 to move the draft frame 23, and thus the moldboard 12, laterally relative to the main frame 20. A tilt actuator 36*c* is attached at opposite ends thereof to the circle frame 26 and the tilt frame 33 to pivot the support 28, and thus the moldboard 12, relative to the circle frame 26 about the pivot axis 30 to change the pitch of the moldboard 12 (see also FIGS. 2-4). A moldboard-sideshift actuator 36*d* is attached to the tilt frame 33 and the moldboard 12 in a conventional manner to sideshift the moldboard 12 relative to the moldboard support 28.

Figure 2:
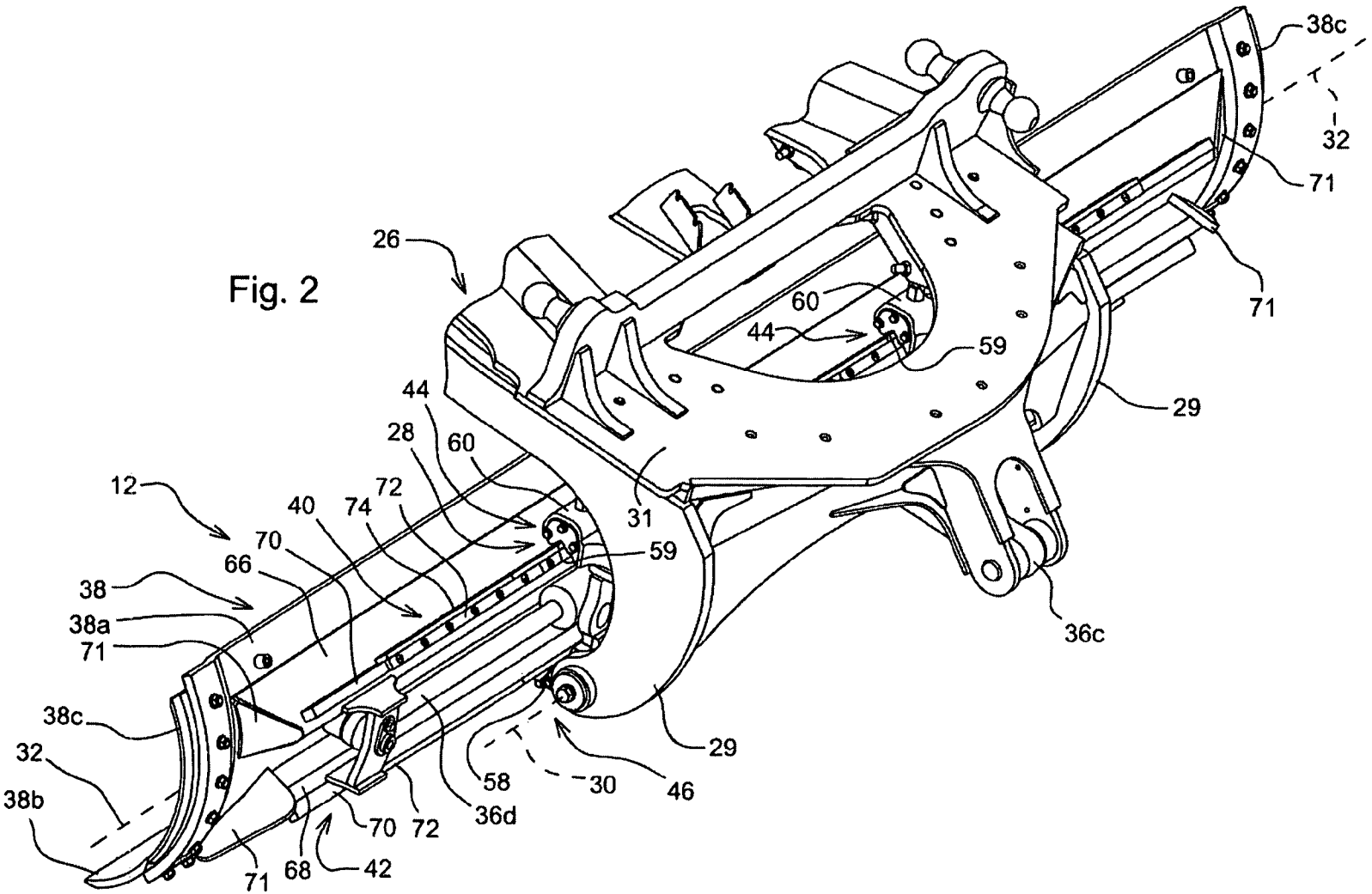
FIG. 2 is a rear perspective view showing a moldboard mounted to a moldboard support, pivotally attached to a circle frame, for sideshifting of the moldboard relative to the moldboard support.

The moldboard 12 has a blade 38, as shown, for example, in FIGS. 2-4. The blade 38 exemplarily includes a longitudinal main plate 38*a*, a bottom cutting edge 38*b* bolted to and extending along a bottom of the main plate 38*a* and two side cutting edges 38*c* bolted to and extending along left and right side edges of the main plate 38*a*, respectively, at left and right sides of the moldboard 12, respectively.

The moldboard 12 further has an upper sideshift rail 40 and a lower sideshift rail 42, as shown, for example, in FIG. 4. Each of the sideshift rails 40, 42 is fixed to the back of the blade 38 so as to be attached thereto, the back being the side of the blade 38 opposite to the working surface of the blade 38. The support 28 holds the moldboard 12 via the upper and lower jaws 44, 46. The upper and lower jaws 44, 46 receive the upper and lower sideshift rails 40, 42, respectively, for slidable movement of the rails 40, 42 against wear components of the jaws 44, 46 upon sideshifting of the moldboard 12 relative to the moldboard support 28 in response to operation of the moldboard-sideshift actuator 36*d*.

As shown, for example, in FIG. 3, the tilt frame 33 exemplarily has a front cross plate 48, a top cross plate 49, and left and right mounts 56. Each mount 56 is included in a respective lower jaw 46 and is provided by a pair of mounting legs 50*a*, 50*b* to which the front and top cross plates 48, 49 are welded, an inner body 51 positioned between and welded to the mounting legs 50*a*, 50*b*, and an outer body 52 welded to the outer mounting leg 50*a* and positioned between that mounting leg 50*a* and a respective circle frame leg 29 of the circle frame 26. Each mount 56 is pivotally attached to a respective circle frame leg 29 via a pin (not shown) extending through a bore defined by that circle frame leg 29 and the associated mounting legs 50*a*, 50*b* and bodies 51, 52 of that mount 56. A pair of bushings (not shown) is positioned in the bore and receives the pin.

The tilt actuator 36*c* is attached to the circle frame 26 and the tilt frame 33 in a conventional manner. A first end of the tilt actuator 36*c* is attached to the circle frame 26 via a pin extending through a pair of lugs of the circle frame 26 and a ring attached to a barrel of the actuator 36*c*. The opposite, second end of the tilt actuator 36*c* is attached to the tilt frame 33 via a pin extending through a pair of lugs welded to the top cross plate 49 and a ring attached to a rod of the actuator 36*c*.

The moldboard-sideshift actuator 36*d* is attached to the tilt frame 33 and the moldboard 12 in a conventional manner. The first end of the actuator 36*d* is attached to the tilt frame 33 via a pin extending through a pair of lugs welded to the front cross plate 48 and a ring attached to the barrel of the actuator 36*d*. The opposite, second end of the actuator 36*d* is attached to the moldboard 12 via a pin extending through a plate of the moldboard 12 and a ring attached to the rod of the actuator 36*d* into a receptacle of the moldboard 12.

Figure 6:
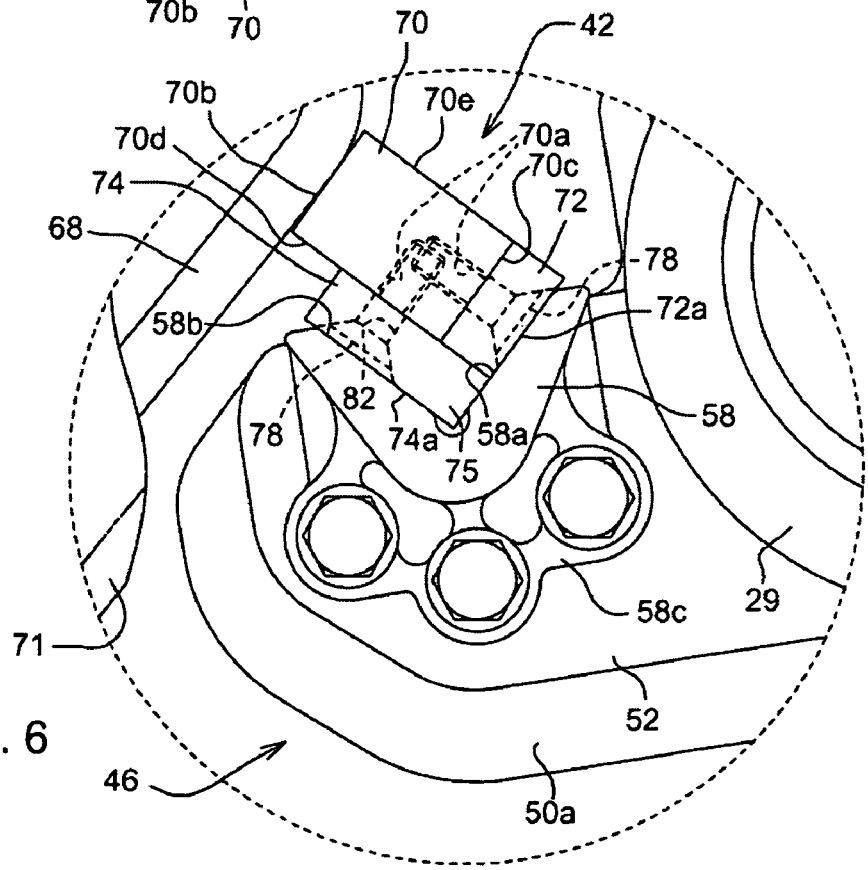
FIG. 6 is an enlarged view of region 6 of FIG. 4 showing a lower sideshift rail having a bar and first and second wear strips removably mounted to the bar.

As shown, for example, in FIGS. 4 and 6, each of the two lower jaws 46 has a mount 56 and two identically configured wear components 58, illustratively in the form of, for example, wear inserts, removably attached to the mount 56 and received in a cradle provided by the mounting legs 50*a*, 50*b* and bodies 51, 52 of the mount 56 of that lower jaw 46, one of the wear components 58 being shown, for example, in FIG. 6. A mounting flange 58*c* of the first of the two wear components 58 (FIG. 6) is bolted to the outer surface of the outer body 52 for removal therefrom, and the mounting flange 58*c* of the second (not shown) of the two wear components 58 is bolted to the inner surface of the mounting leg 50*b* for removal therefrom. The mounting flanges 58*c* of the wear components 58 are thus positioned against opposite sides of the respective lower jaw 46. When the two wear components 58 of each jaw 46 are bolted to that jaw 46, there may be a slight gap between them to accommodate manufacturing tolerances of the mount 56. The wear components 58 of each jaw 46 cooperate to provide a V-shaped mouth for receiving the lower sideshift rail 42.

Figure 5:
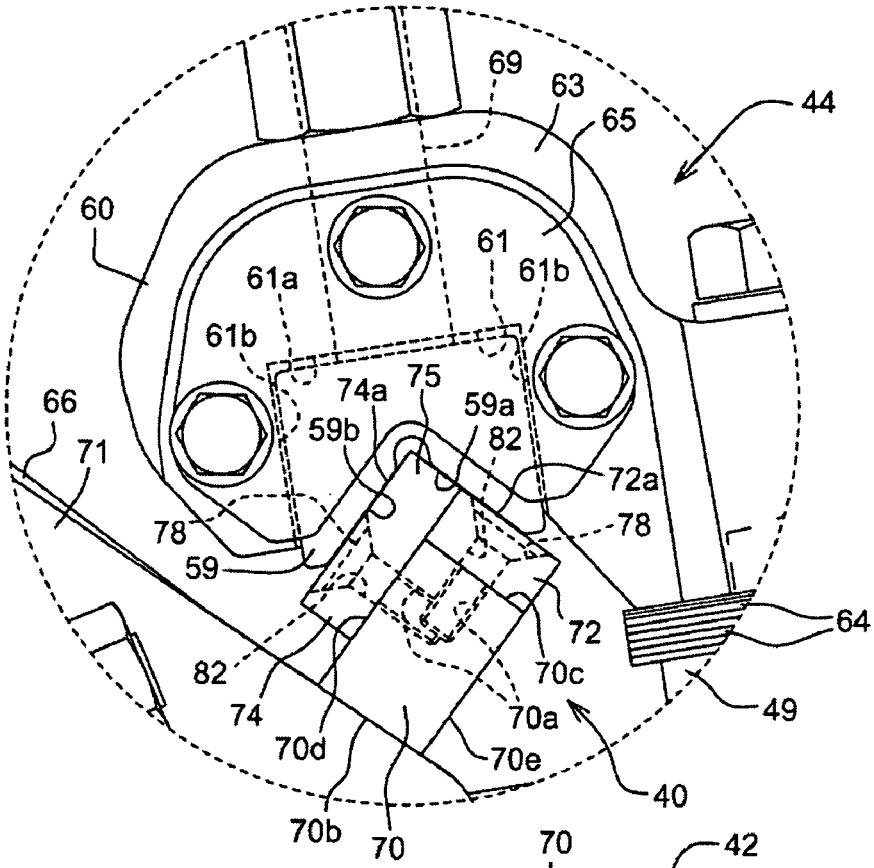
FIG. 5 is an enlarged view of region 5 of FIG. 4 showing an upper sideshift rail having a bar and first and second wear strips removably mounted to the bar.

Each upper jaw 44 has a wear component 59 and a component retainer 60, as shown, for example, in FIGS. 4 and 5 with respect to one of the upper jaws 44. Each component retainer 60 is removably attached (e.g., bolted) to the top cross plate 49. A number of shims 64 may be removably positioned between the retainer 60 and the top cross plate 49 to help establish the grip of the jaws 44, 46 on the rails 40, 42. Each wear component 59, illustratively in the form of, for example, a wear insert, has, for example, a V-shaped mouth for receiving the upper sideshift rail 40 and is removably positioned in a cavity 61 of the retainer 60.

Each component retainer 60 has a C-shaped body 63 (in the form of, for example, a casting) opening downwardly and a pair of end plates 65. The end plates 65 are removably attached (e.g., bolted) to opposite ends of the C-shaped body 63. One of the end plates 65 is shown in FIG. 5, and the other is configured and mounted like the end plate 65 shown but on the opposite end of the body 63. An upper wall 61*a* and two side walls 61*b* of the body 63 cooperate with the end plates 65 to define the cavity 61. The cavity 61 is over-sized in that there is a lateral clearance between the component 59 and one or both of the side walls 61*b* of the cavity 61 and a longitudinal clearance (not shown) between the component 59 and one or both of the end plates 65. This extra space in the cavity 61 allows for variance within the manufacturing tolerances of the moldboard 12, the support 28, and other associated components of the motor grader.

A number of force applicators 69 (e.g., two) are manually adjustable by an operator to push the component 59 downwardly against the upper sideshift rail 40 such that the jaws 44, 46 cooperate to hold the sideshift rails 40, 42 and thus the moldboard 12. The force applicators 69 and the shims 64, if any, thus cooperate to establish the grip of the jaws 44, 46 on the rails 40, 42.

Each force applicator 69 includes, for example, a threaded cap screw and a lock nut threaded to the cap screw. The cap screw extends through, and is threaded to, the body 63 and the nut and extends to the cavity 61 and contacts a top surface of the component 59. The downward force applied to the component 59 by a force applicator 69 can be adjusted by rotating the cap screw in one direction to increase the force and in the opposite direction to decrease the force. Further, as the component 59 wears, the cap screw can be rotated so as to be advanced toward the component 59 to tighten the grip of the component on the rail 40. To unlock the cap screw for movement toward the component 59, the lock nut is first loosened by rotating the nut on the cap screw so as to back the nut away from the top of the body 63. Once the cap screw has been adjusted as desired, the lock nut is re-tightened against the top of the body 63 so as to lock the cap screw into place. (See also, for example, U.S. patent application Ser. No. 11/608,670, filed on 8 Dec. 2006 and entitled "Wrenchless Adjustable/Compliant Moldboard Insert," and the disclosure associated with FIGS. 5 and 6 thereof.)

Figure 7:
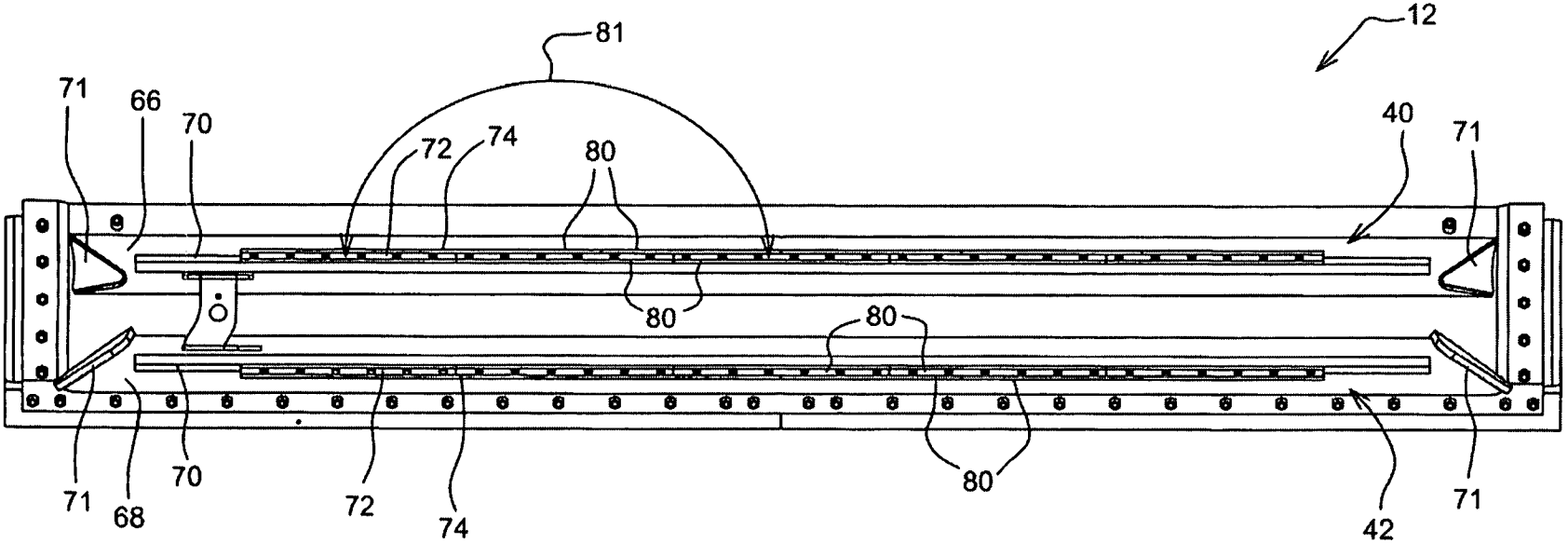
FIG. 7 is a rear elevation view of the moldboard.

The upper and lower sideshift rails 40, 42 are attached to the back of the blade 38 via upper and lower longitudinal channels 66, 68, respectively, as shown, for example, in FIG. 7. The sideshift rails 40, 42 are thus parallel to one another. The longitudinal channels 66, 68 are configured, for example, as elongated angle brackets, and are fixed (e.g., welded) to the back of the blade 38 so as to reinforce the blade 38. An end plate 71 is welded to the ends of each channel 66, 68.

Each rail 40, 42 has a bar 70 and two wear strips 72, 74, as shown, for example, in FIG. 4. Each bar 70 is a solid piece of material that is longer than it is wide, and exemplarily has a number of fastener-receiving holes 70*a*, discussed below, that do not detract from its character as a bar. Each bar 70 may be made of, for example, weldable steel, AISI 1020 steel, or a high strength low alloy steel. The bars 70 are fixed (e.g., welded) to the upper and lower longitudinal channels 66, 68, respectively. The wear strips 72, 74 of each rail 40, 42 are removably mounted to the bar 70 of that rail 40, 42 and minimize wear on the bar 70.

Exemplarily, each bar 70 is rectangular so as to comprise first and second surfaces 70*b*, 70*c* opposite to one another and third and fourth surfaces 70*d*, 70*e* opposite to one another and interconnecting the first and second surfaces 70*b*, 70*c*, as shown, for example, in FIGS. 5 and 6. The third surfaces 70*d* face at least partially away from one another. The fourth surfaces 70*e* face at least partially toward one another. The bar 70 of the upper sideshift rail 40 is fixed to the upper longitudinal channel 66 (e.g., welded, not shown, in the region of the corners between the surfaces 70*b*, 70*d* and between the surfaces 70*b*, 70*e*). As such, the first surface 70*b* of the bar 70 of the upper sideshift rail 40 is positioned on the upper longitudinal channel 66 and the upper longitudinal channel 66 is positioned between the back of the blade 38 and bar 70 of the upper sideshift rail 40. The bar 70 of the lower sideshift rail 42 is fixed to the lower longitudinal channel 68 (e.g., welded, not shown, in the region of the corners between the surfaces 70*b*, 70*d* and between the surfaces 70*b*, 70*e*). As such, the first surface 70*b* of the bar 70 of the lower sideshift rail 42 is positioned on the lower longitudinal channel 68 and the lower longitudinal channel 68 is positioned between the back of the blade 38 and the bar 70 of the lower sideshift rail 42.

The wear strips 72, 74 of each rail 40, 42 are removably mounted on the bar 70 of that rail 40, 42 so as to extend lengthwise along such bar 70, as shown, for example, in FIG. 7. With respect to each rail 40, 42, the first wear strip 72 is positioned on the second surface 70*c*, and the second wear strip 74 is positioned on the third surface 70*d*, as shown, for example, in FIG. 4. Thus, in an end view of the respective sideshift rail 40, 42 (FIGS. 5 and 6), the first and second wear strips 72, 74 are arranged in a V-shaped strip configuration 75, such that a portion of the first wear strip 72 overlaps a portion of the second wear strip 74 to form the vertex of the V-shaped strip configuration 75.

The two upper jaws 44 receive the V-shaped strip configuration 75 of the upper sideshift rail 40 (FIGS. 4 and 5), and the two lower jaws 46 receive the V-shaped strip configuration 75 of the lower sideshift rail 42 (FIG. 4). The V-shaped strip configuration 75 of the upper sideshift rail 40 mates with the V-shaped mouth of each wear component 59. As such, a contact surface 72*a*, provided by the first and second wear strips 72, 74 of the rail 40 (primarily the first wear strip 72), slidably contacts a corresponding contact surface 59*a* of the respective component 59, and a contact surface 74*a* of the second wear strip 74 of the rail 40 slidably contacts a corresponding contact surface 59*b* of the respective component 59.

The V-shaped strip configuration 75 of the lower sideshift rail 42 mates with the V-shaped mouth of each wear component 58. As such, a contact surface 72*a*, provided by the first and second wear strips 72, 74 of the rail 42 (primarily the first wear strip 72), slidably contacts corresponding contact surfaces 58*a* of the wear components 58 of each lower jaw 46, and a contact surface 74*a* of the second wear strip 74 of the rail 42 slidably contacts corresponding contact surfaces 58*b* of the wear components 58 of each lower jaw 46.

Figure 8:
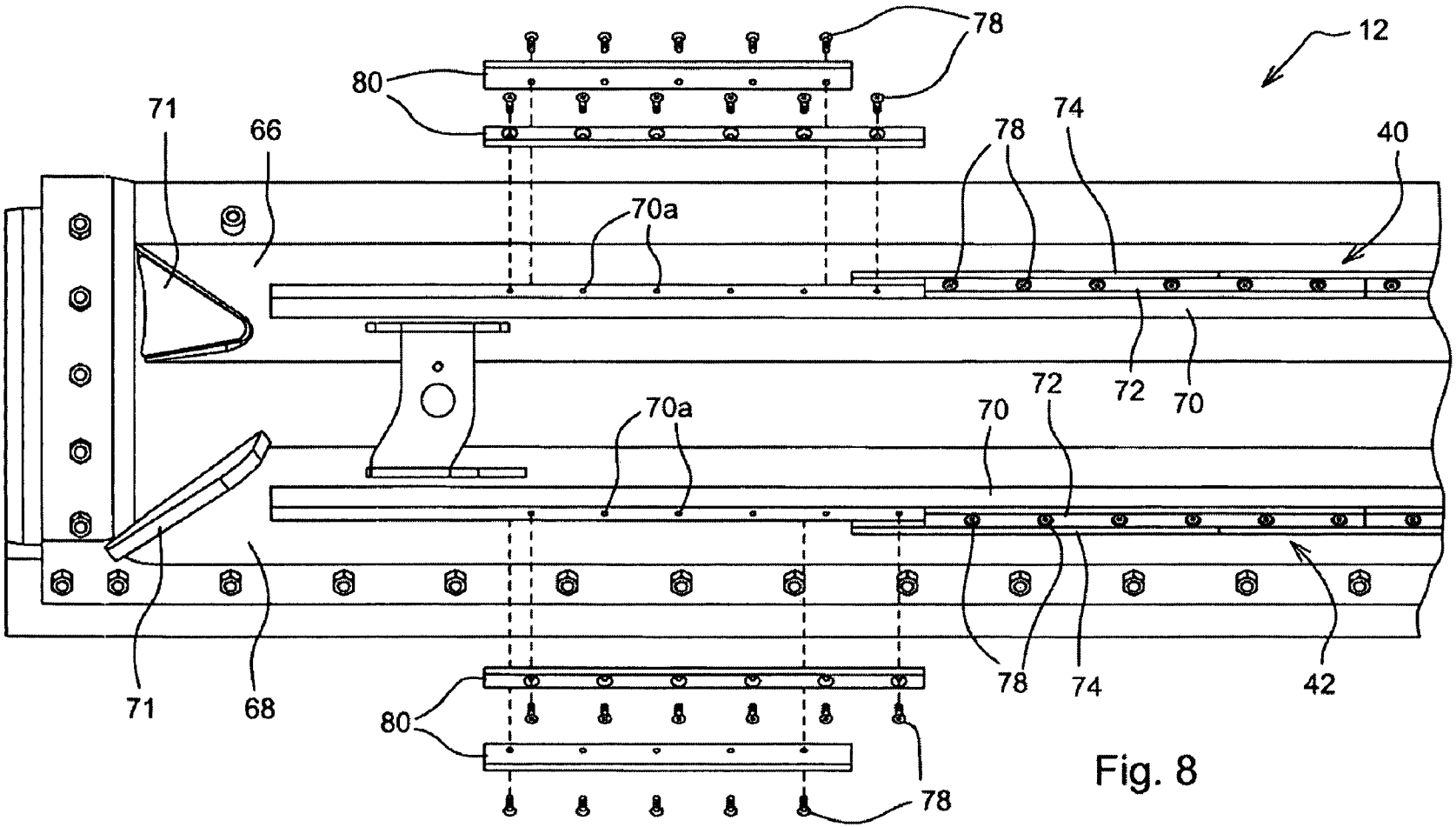
FIG. 8 is an enlarged rear elevation view of a portion of the moldboard showing that each of the wear strips of the upper and lower sideshift rails is segmented along its length so as to comprise a plurality of individual strip segments removably mounted to the bar of the respective rail in-line with one another.

Each strip 72, 74 is segmented along its length so as to comprise a plurality of individual strip segments 80 removably mounted to the bar 70 in-line with one another, as shown, for example, in FIGS. 7 and 8. The strip segments 80 are exemplarily all the same length. In an end view (FIGS. 5 and 6), each strip segment 80 is rectangular. Each strip segment 80 is fastened to the respective bar 70 with a number of fasteners 78 countersunk into that strip segment 80, as shown, for example, in FIG. 8. Each strip segment 80 is drilled and countersunk so as to define a number of fastener-receiving holes 82 through which the fasteners 78 extend into corresponding drilled and tapped fastener-receiving holes 70*a* defined in the respective bar 70 to mount the strip segment 80 on that bar 70.

The segmented configuration of the strips 72, 74 allows any worn segment 80 to be replaced readily with another, less worn segment 80. Each worn segment 80 may be unfastened and removed from the bar 70 upon loosening and removal of the fasteners 78 from the bar 70. The worn segment 80 may then be replaced with a replacement segment 80 by positioning the less worn segment 80 on the bar 70 in the former location of the worn segment 80 and fastening the less worn segment 80 to the bar 70 with the fasteners 78.

The replacement segment 80 may be a new segment 80, or may be one of the other segments 80 already attached to the moldboard 12 but not worn as much as the worn segment 80. In the case where the replacement segment 80 is already attached to the moldboard 12, the worn segment 80 and the replacement segment 80 may be interchanged by unfastening them from their respective bar(s) 70 and re-fastening each in the former location of the other segment 80, as shown, for example, in FIG. 7 by double-head arrow 81. Of course, more than two segments 10 could be involved in a segment interchange.

This segment-interchange aspect of the present disclosure may be particularly useful in the context of a rail 40, 42 that may experience uneven wear along its length. A region of the rail 40, 42 may experience more wear than another region of that rail 40, 42. In the case where the vehicle 10 may be a motor grader, most wear is usually confined to short portions of the total length of the rails 40, 42 (e.g., in the middle region of the rails 40, 42 where most rail-jaw contact occurs), and segments 80 with such wear may be interchanged with strips 80 showing little wear from another region (e.g., in an end region of the rails 40, 42). This could be done at the job site with minimal effort. At a more convenient time, the worn segments 80 may be replaced with new segments 80.

Such rail maintenance on a work vehicle 10 could be done without having to replace the entire moldboard 12 with a new moldboard, without having to remove the moldboard 12 from the support 28, and without having to remove the bar 70 of the subject rail 40, 42 from the respective longitudinal channel 66, 68 (which bar 70 may have been welded to such channel 66, 68). In this way, the useful life of the moldboard 12 may be prolonged well beyond the useful life of its rail components.

The segments 80 of the strips 72, 74 may be highly resistant to wear and brittle fracture and may be hardened. Since the segments 80 are not welded to the moldboard 12 or the bars 70 thereof, or anything else, but are attached to the respective bar 70 with fasteners 78 (FIG. 8), the segments 80 may be made very hard, even harder than the bars 70, as long as they do not become brittle and fracture during impact, thereby increasing wear life of the segments 80. The hardness of the segments 80 is not dependent on the hardness of the bars 70 (which would likely be unhardened). Because the segments 80 are not welded to the moldboard 12 or bars 70, the segments 80 are able to have a higher hardness level than if they were welded to the moldboard 12. As such, the segments 80 of the strips 72, 74 may be harder than the bars 70, which are, for example, welded to the respective longitudinal channels 66, 68. Attaching the segments 80 to the respective bar 70 with fasteners 78 (FIG. 8), instead of welding, thus promotes such hardness of the strips 72, 74.

Exemplarily, the hardness level of the segments 80 may be between 50 Rc and 55 Rc (Rc means Hardness Rockwell Scale C), or in the mid 50's Rc. The hardness level selected for the segments 80 would depend on the outcome of optimization without undue experimentation. In an example, the segments 80 may be made of any hardenable alloy steel, such as, for example, AISI 4340 steel hardened to 55 Rc.

The segments 80 may be hardened in different ways. For example, the segments 80 may be heat treated. In another example, the segments 80 may be coated with a wear resistant coating.

The wear components 58, 59 may also be coated with a wear resistant coating, such as, for example, CDC-2 (i.e., Composite Diamond Coating-2) or other wear resistant coating, as disclosed in U.S. patent application Ser. No. 12/045,549 which was filed on 10 Mar. 2008, is entitled "Use of Composite Diamond Coating on Motor Grader Wear Inserts," and is hereby incorporated by reference herein. The wear components 58 or 59 or both the wear components 58 and 59 may be so coated.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A work vehicle, comprising:

a moldboard support, and a moldboard mounted to the moldboard support, the moldboard comprising a blade and a sideshift rail, the sideshift rail comprising a bar attached to the blade and a wear strip removably mounted to, and extending along, the bar so as to cover at least a portion of the bar and contacting the moldboard support for slidable movement against the moldboard support upon sideshifting of the moldboard relative to the moldboard support, wherein the wear strip is fastened to the bar with at least one fastener.

2. The work vehicle of claim 1, wherein the wear strip is segmented along its length so as to comprise a plurality of individual strip segments removably mounted to the bar in-line with one another.

3. The work vehicle of claim 2, wherein each strip segment is fastened to the bar with at least one fastener countersunk into that strip segment.

4. The work vehicle of claim 1, wherein at least a portion of the wear strip is hardened.

5. The work vehicle of claim 4, wherein at least a portion of the wear strip is harder than the bar.

6. The work vehicle of claim 1, wherein the wear strip is a first wear strip, the sideshift rail comprises a second wear strip removably mounted to, and extending along, the bar so as to cover at least a portion of the bar and contacting the moldboard support for slidable movement against the moldboard support upon sideshifting of the moldboard relative to the moldboard support.

7. The work vehicle of claim 6, wherein the first wear strip is mounted on a first surface of the bar, and the second wear strip is mounted on a second surface of the bar.

8. The work vehicle of claim 6, wherein, in an end view of the sideshift rail, the first and second wear strips are arranged in a V-shaped strip configuration.

9. The work vehicle of claim 8, wherein a portion of the wear strip overlaps a portion of the second wear strip to form the vertex of the V-shaped strip configuration.

10. The work vehicle of claim 8, wherein the moldboard support comprises a wear component, and the V-shaped strip configuration at least partially mates with the wear component.

11. The work vehicle of claim 6, wherein each wear strip is segmented along its length so as to comprise a plurality of individual strip segments removably mounted to the sideshift rail in-line with one another.

12. The work vehicle of claim 11, wherein each strip segment of each wear strip is fastened to the sideshift rail with at least one fastener.

13. The work vehicle of claim 6, comprising a longitudinal channel attached to the back of the blade and positioned between the blade and the bar, the bar is rectangular so as to comprise first and second surfaces opposite to one another and third and fourth surfaces opposite to one another and interconnecting the first and second surfaces, the first surface is positioned on the longitudinal channel, the first wear strip is removably mounted on the second surface, and the second wear strip is removably mounted on the third surface.

14. The work vehicle of claim 1, wherein the sideshift rail is an upper sideshift rail, the wear strip is a first wear strip, the moldboard support comprises an upper jaw and a lower jaw each of which comprises a wear component, the upper sideshift rail is received by the wear component of the upper jaw, the moldboard comprises a lower sideshift rail received by the wear component of the lower jaw, the upper sideshift rail comprises the bar, the first wear strip, and a second wear strip, the lower sideshift rail comprises a bar attached to the blade, a first wear strip, and a second wear strip, each of the first and second wear strips of the upper sideshift rail is removably mounted to, and extends along, the bar of the upper sideshift rail so as to cover at least a portion of that bar and contacts the wear component of the upper jaw for slidable movement against that wear component upon sideshifting of the moldboard relative to the moldboard support, and each of the first and second wear strips of the lower sideshift rail is removably mounted to, and extends along, the bar of the lower sideshift rail so as to cover at least a portion of that bar and contacts the wear component of the lower jaw for slidable movement against that wear component upon sideshifting of the moldboard relative to the moldboard support.

15. The work vehicle of claim 14, comprising upper and lower longitudinal channels attached to the back of the blade, each of the bars is rectangular so as to comprise first and second surfaces opposite to one another and third and fourth surfaces opposite to one another and interconnecting the first and second surfaces, the third surfaces face at least partially away from one another, the fourth surfaces face at least partially toward one another, the first surface of the bar of the upper sideshift rail is positioned on the upper longitudinal channel, the first surface of the bar of the lower sideshift rail is positioned on the lower longitudinal channel, the first wear strip of each sideshift rail is positioned on the second surface of the bar of that sideshift rail, and the second wear strip of each sideshift rail is positioned on the third surface of the bar of that sideshift rail.

16. A moldboard for use with a work vehicle, the work vehicle comprising a moldboard support, the moldboard comprising:

a blade, and a sideshift rail, the sideshift rail comprising a bar attached to the blade and a wear strip removably mounted to, and extending along, the bar so as to cover at least a portion of the bar and adapted to contact the moldboard support for slidable movement against the moldboard support upon sideshifting of the moldboard relative to the moldboard support, wherein the wear strip is fastened to the bar with at least one fastener.

17. A method for use with a work vehicle, the work vehicle comprising a moldboard support and a moldboard mounted to the moldboard support, the moldboard comprising a blade and a sideshift rail, the sideshift rail comprising a bar attached to the blade and a wear strip removably mounted to, and extending along, the bar so as to cover at least a portion of the bar and contacting the moldboard support for slidable movement against the moldboard support upon sideshifting of the moldboard relative to the moldboard support, wherein the wear strip is fastened to the bar with at least one fastener, the method comprising:

removing at least a portion of the wear strip from the bar, and replacing the at least the portion of the wear strip with another wear strip or wear strip portion such that the other wear strip or wear strip portion is removably mounted to the bar with at least one fastener.

18. The method of claim 17, wherein the wear strip is segmented along its length so as to comprise a plurality of individual strip segments removably mounted to the bar in-line with one another, the removing comprises removing a first strip segment of the plurality of individual strip segments from the bar, and the replacing comprises replacing the first strip segment with a second strip segment such that the second strip segment is removably mounted to the bar.

19. The work vehicle of claim 18, wherein the removing comprises unfastening the first strip segment, and the replacing comprises fastening the second strip segment to the bar.

* * * * *